United States Patent [19]

Moro

[11] Patent Number: 5,053,813

[45] Date of Patent: Oct. 1, 1991

[54] ELECTROPHOTOGRAPHIC COPYING APPARATUS HAVING TWO COPY-START KEYS

[75] Inventor: Akihiro Moro, Tokyo, Japan

[73] Assignee: Kabushiki Kaisha Toshiba, Kawasaki, Japan

[21] Appl. No.: 429,090

[22] Filed: Oct. 30, 1989

[30] Foreign Application Priority Data

Oct. 31, 1988 [JP] Japan ..... 63-272914

[51] Int. Cl.[5] ..... G03G 21/00; G03G 15/00

[52] U.S. Cl. ..... 355/201; 355/200; 355/208

[58] Field of Search ..... 355/204, 208, 201, 202, 355/200, 313, 210; 200/317

[56] References Cited

U.S. PATENT DOCUMENTS 4,639,120 1/1989 Matsuura ..... 355/210

FOREIGN PATENT DOCUMENTS 0208559 11/1984 Japan .
0210454 11/1984 Japan ..... 355/201
0083551 4/1986 Japan ..... 355/201
0090169 5/1986 Japan ..... 355/201
0277976 12/1986 Japan ..... 355/201
08539 11/1989 Japan .

*Primary Examiner*—A. T. Grimley
*Assistant Examiner*—Nestor R. Ramirez
*Attorney, Agent, or Firm*—Foley & Lardner

[57] ABSTRACT

An image forming apparatus is provided which includes first and second copy-start keys. The first key remains continuously in the enabled state, while the second key is normally in the disabled state. The second key is enabled only when an inputted ID number is identical to a registered ID number previously stored in the apparatus.

2 Claims, 6 Drawing Sheets

ELECTROPHOTOGRAPHIC COPYING APPARATUS HAVING TWO COPY-START KEYS

BACKGROUND OF THE INVENTION

1. Field of the Invention

This invention relates to an image forming apparatus, and more particularly to an image forming apparatus having plural copy-start keys to start reading images from originals and forming the read images on sheets.

2. Description of the Prior Art

Conventionally, some color copying machines have plural copy-start keys that allow the machine to start the copying operation. Such keys are generally provided at positions adjacent to an original table. When an original is to be copied, the original is set on the original table, and one of such keys is pressed so as to start the copying operation.

The above-described conventional machines have the following disadvantages. Specifically, any of the copy-start keys may be erroneously pressed by the operator's hands or by originals, potentially resulting in an undesired copying operation. In addition, recently, only some particular qualified operators are allowed to make copies using such keys, because of copyright infringement concerns.

SUMMARY OF THE INVENTION

Accordingly, one object of this invention is to provide an image forming apparatus having plural copy-start keys, which are protected from an undesirable copying operation. One of the keys may be enabled only by qualified operators.

Briefly, in accordance with one aspect of this invention, there is provided an image forming apparatus which comprises first means for continuously enabling a first key of the copy-start keys, and second means for maintaining a second key of the copy-start keys in a disabled state, and for selectively releasing the second key from the disabled state into an enabled state.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
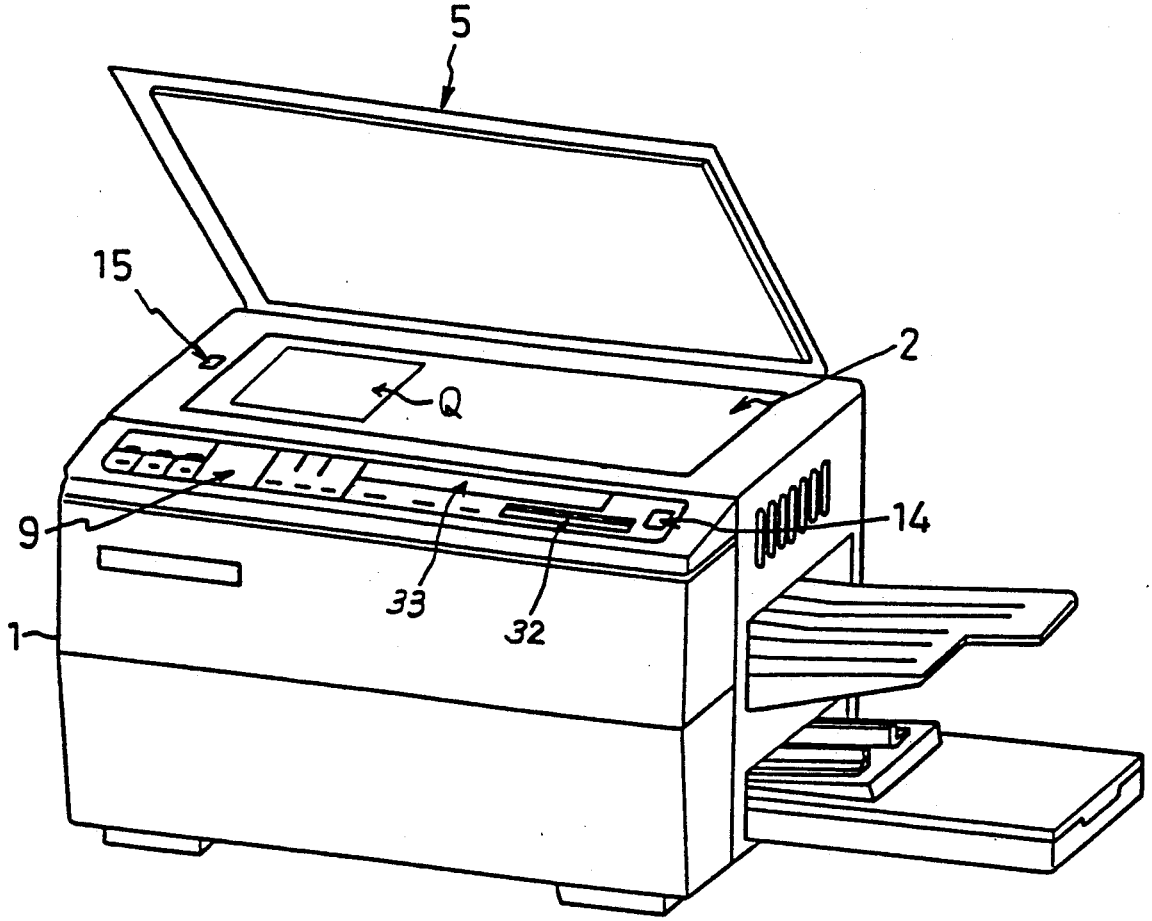
FIG. 1 is a perspective view illustrating a thermal transfer-type color copying machine employing one embodiment according to the present invention.

Referring now to the drawings, wherein like reference numerals designate identical or corresponding parts throughout the several views, and more particularly to FIG. 1 thereof, one embodiment of this invention will be described.

FIG. 1 shows an image forming apparatus, which is a thermal transfer-type color copying machine, employing one embodiment according to the present invention. In FIG. 1, a glass original table 2 is provided in the upper portion of a color copying machine 1. An original table cover 5 is mounted on the original table 2 so as to be freely opened/closed.

A control panel 9 is provided in the front of the machine 1, and a first copy-start key 14 is provided at the right end of the control panel 9. The first copy-start key 14 is always operable, and any operator can use it at any time to operate the apparatus. A second copy-start key 15 is provided at a position adjacent to the left side of the original table 2. The second copy-start key 15 is not operable all the time. In addition, the key 15 is enabled only when a specified condition, which will be later described in detail, is satisfied. In ordinary copying, an original Q is placed on the original table 2, and the original table cover 5 is closed. An operator then presses the first copy-start key 14. In this case, the second copy-start key 15 has been disabled, because the normal copying operation has been selected by the operator. Thus, the key 15 will not cause an undesired copying operation which may occur when the operator erroneously touches the second copy-start key 15 in the following instances. Specifically, such erroneous touches could be made when the operator places the original Q on the original table 2, or when the operator closes the original table cover 5.

Figure 2:
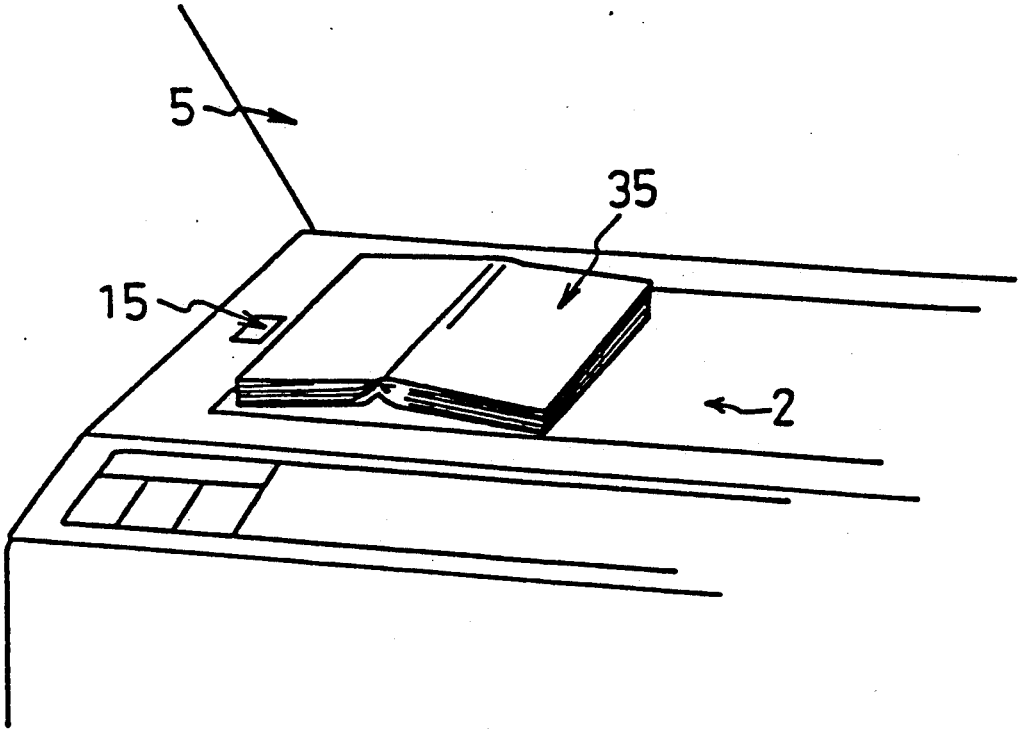
FIGS. 2 and 3 are a partially enlarged perspective view and a partially enlarged plan view, each for explaining the operation of one embodiment according to the present invention.
Figure 3:
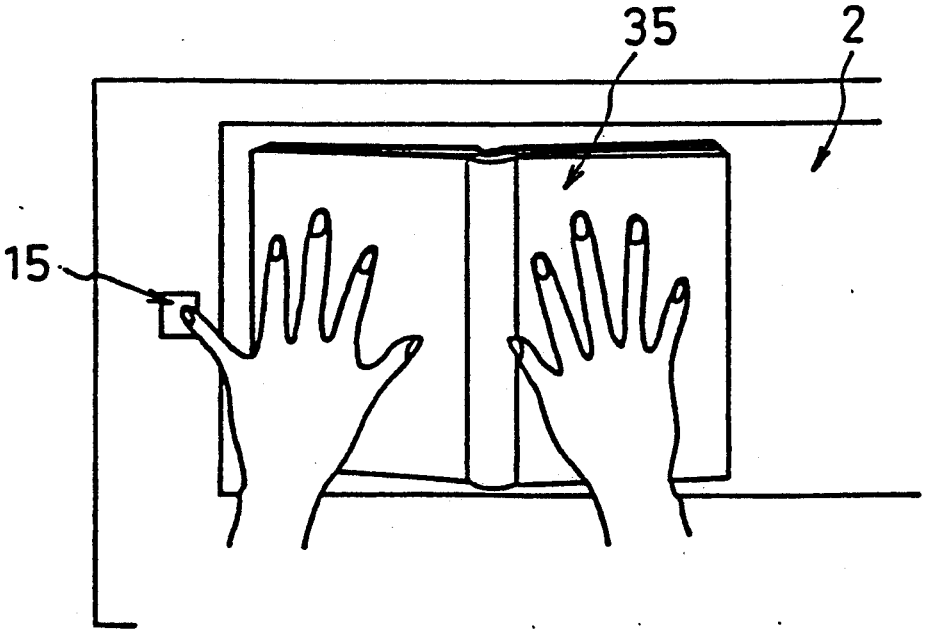

The second copy-start key 15 can be enabled only when the operator inputs a particularly specified ID number (identification number) by the use of control panel 9. The second copy-start key 15 is necessary when a thick book is used as an original to be copied. FIGS. 2 and 3 show the case when a book 35 is to be copied after the operator has selected the book copy mode from the control panel. The book 35, with desired pages opened is placed on the original table 2, as shown in FIG. 2. The book 35 is so thick that the original table cover 5 cannot be closed. Thus, prior to copying, the thick book 35 must be depressed by the operator using both hands such that the clearance between the book 35 and the original table 2 is minimized. In this case, the operator cannot press the first copy-start key 14 because both hands of the operator must be used to depress the book 35. Thus, the second copy-start key 15 is pressed instead by using the left little finger of the operator as shown in FIG. 3. In this case, the second copy-start key 15 has already been enabled in a prescribed manner, which will be later described in detail. As a result, the desired pages of the book 35 can be easily copied. After the completion of book-copying, the second copy-start key 15 is returned to the disabled state. Thereafter, only the first copy-start key 14 is operable.

In this embodiment, there is also provided another advantage such that the use of the second copy-start key 15 can be limited to particularly specified operators. In other words, it may be advantageous to designate only certain operators who are allowed to copy a book with many pages.

Figure 4:
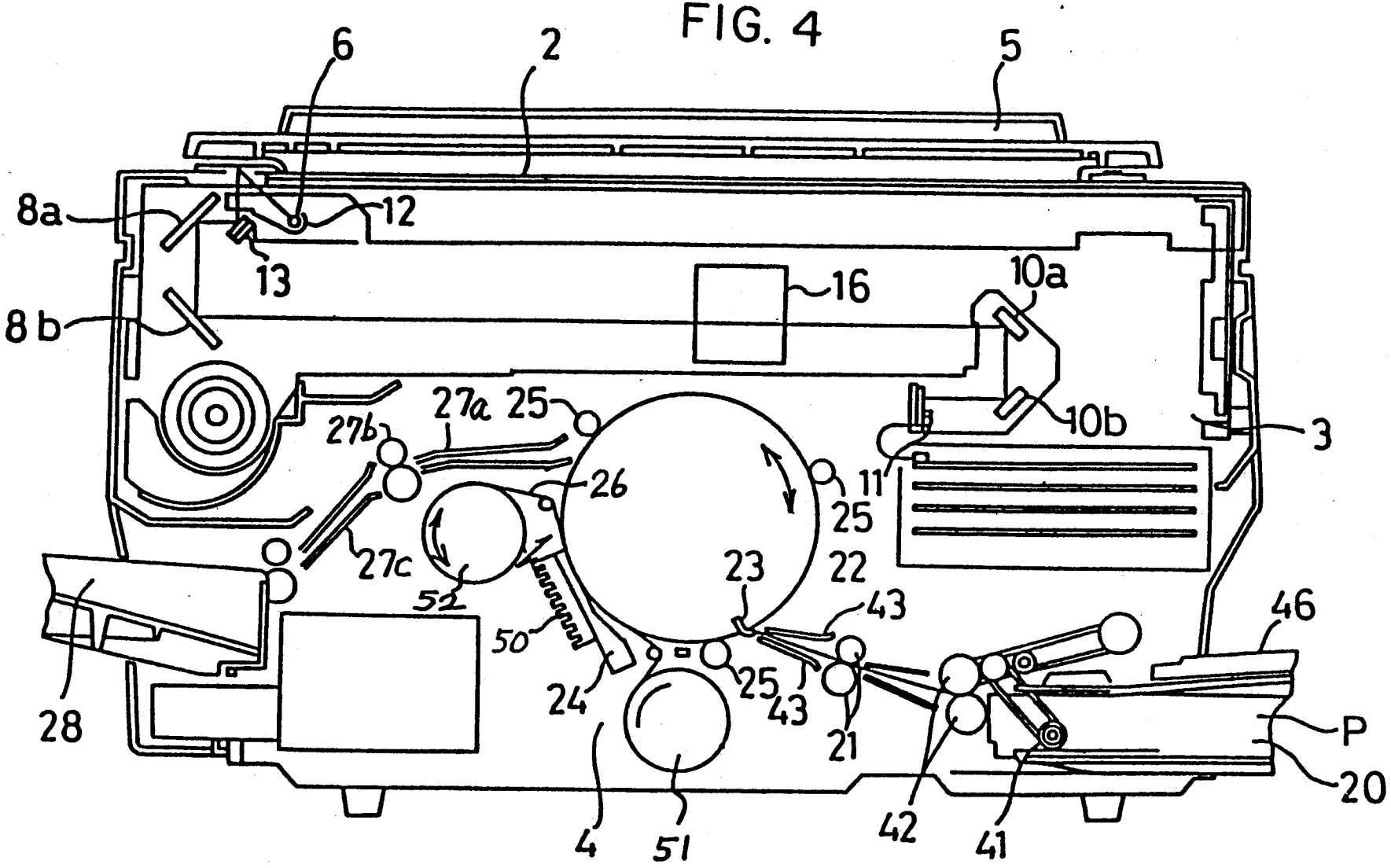
FIG. 4 is a schematic cross-sectional view of FIG. 1.

FIG. 4 is a schematic cross-sectional view illustrating the inner configuration of the thermal transfer-type color copying machine of FIG. 1. In FIG. 4, an original scanning apparatus 3 comprises an illumination lamp 6, mirrors 13, 8*a* and 8*b*, and a lens unit 16. The apparatus 3 further comprises mirrors 10*a* and 10*b*, a photoelectric transducer 11, and a drive mechansim (not shown). A reflector 12 is provided close to the illumination lamp 6 such that light from the lamp 6 is reflected and focused on the original Q placed on the original table 2. The light reflected from the original Q is led by the mirror 13 to the mirrors 8*a* and 8*b* which in turn lead the light to the lens unit 16. The mirrors 8*a* and 8*b* are moved in the same direction but at half the speed of the mirror 13. The speed difference therebetween can achieve a satisfactory original image scanning while maintaining an optical distance substantially constant between the original Q and the lens unit 16. The lens unit 16 is of a fixed focus-type, and is moved in the optical axis direction in the case of image-enlargement/reduction. The mirrors 10*a* and 10*b* are moved to prescribed positions in accordance with the changes of optical distances corresponding to a ratio of the image-enlargement or reduction. The light from the lens unit 16 is reflected by the mirrors 10*a* and 10*b* so as to focus the original image on the photoelectric transducer 11. The movements of mirrors 10*a* and 10*b* and the lens unit 16 are respectively performed by the use of separately provided stepping motors (not shown) associated with corresponding spiral shafts (not shown).

The photoelectric transducer 11 converts the thus received original image into electric signals that represent colors such as cyan, green and yellow and outputs the same. The photoelectric transducer 11 is mainly constituted by a line image sensor, such as a CCD (charge-coupled device)-type image sensor, for example. The output color signals from the photoelectric transducer 11 are fed into an A/D (analog-to-digital) converter (not shown).

An image printing apparatus 4 is provided substantially at the center of the machine 1, and comprises a platen drum 22, ink ribbon rollers 51 and 52, and a thermal head 24. The platen drum 22 has an outer circumference made of an elastic member such as rubber, and serves as a platen roller. The platen drum 22 rotates clockwise so as to wind a sheet P around its outer circumference. Further, pressure rollers 25 are provided on the outer circumference of the platen drum 22 so as to hold the sheet P fast thereto. Thus, the sheet P is free from undesirable shifts while the color-overlaying is being performed. The entire length of the outer circumference of the platen drum 22 is designed to be slightly greater than the length of the maximum applicable sheet.

The thermal head 24 has a heater 50 attached to its back portion. An ink ribbon 26 is provided between the platen drum 22 and the thermal head 24. The ink ribbon rollers 51 and 52 are coupled to an electric motor through an appropriate drive mechanism (not shown) so as to be rotated in a prescribed manner. A paper supply cassette 20 containing sheets P is provided in the lower right portion of the machine 1. The sheet P is picked up and fed forward by a pair of paper feed rollers 41. The sheet P is then aligned by a pair of aligning rollers 21, and further fed through a pair of guides 43 toward the platen drum 22. The sheet P is gripped by a gripper 23 and wound around the outer circumference of the platen drum 22 that rotates in a prescribed manner. The paper supply cassette 20 is detachably mounted on the machine 1, i.e., it is easily removed from the side surface. A manual paper supply 46 is provided adjacent to the paper supply cassette 20, and it serves to manually supply sheets P. The sheet P from the manual paper supply 46 is also wound around the outer circumference of the platen drum 22 in the same manner as above. After the leading end of the sheet P has passed a prescribed position, the sheet P is set at a position corresponding to the specified printing area. The thermal head 24 is then pressed against platen drum 22 so as to perform printing.

After the printing of a single color has been completed, the plate drum 22 is rotated by a single revolution. In this case, the thermal head 24 is retracted, and then the ink ribbon 26 is wound by the roller 52 so as to position a next-required color area to a prescribed position. The platen drum 22 then starts a next single revolution in the clockwise direction. At the same time, the thermal head 24 is again pressed against the platen drum 22 so as to perform overlaying-printing.

As described above, in the case of full color copying, printing procedures are performed four times for printing colors such as yellow, magenta, cyan and black. In some cases, such printing procedures are performed three times for printing colors such as yellow, magenta and cyan. In the case of monochrome copying, i.e., a single color such as black, a single printing procedure is performed.

After the completion of the printing process, the platen drum 22 further rotates clockwise. When the trailing end of the sheet P reaches the entrance of a paper discharge guide 27*a*, the platen drum 22 then rotates counterclockwise. The trailing end of the sheet P is peeled off the platen drum 22 by the use of a separation claw (not shown). This causes the sheet P to be fed into a pair of discharge rollers 27*b* through the paper discharge guide 27*a*. Finally, the leading end of the sheet P is released from the gripper 23, and the sheet P is further fed into a paper discharge tray 28 through a paper discharge guide 27*c*.

Figure 5:
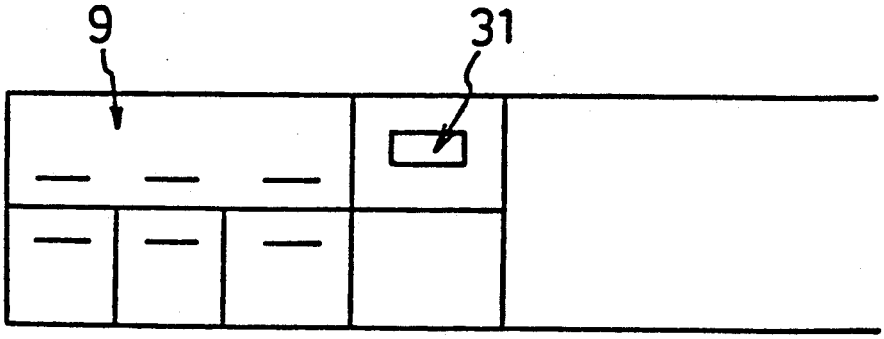
FIGS. 5 and 6 are enlarged plan views illustrating partial portions of FIG. 1.
Figure 6:
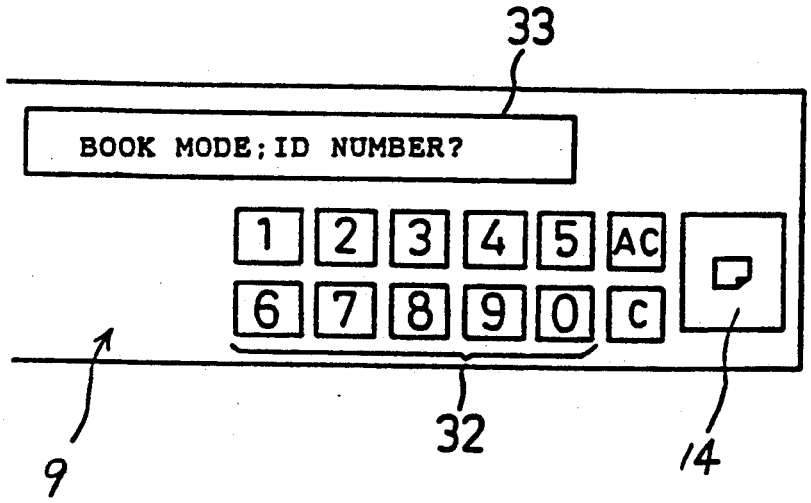

FIGS. 5 and 6 are schematic plan views respectively illustrating partial portions of the control panel 9. The control panel 9 includes the first copy-start key 14, a message display 33, and a ten-key numerical input pad 32. In FIG. 5, a book-mode key 31 is provided substantially at the center of the control panel 9. The book mode key 31 serves to enable and disable the second copy-start key 15. Specifically, assume that the second copy-start key 15 is in the disabled state. When the book-mode key 31 is pressed, a message display 33 indicates that an ID number is requested. In accordance with this display, the operator inputs an ID number identical to the ID number which has been registered in the machine 1. As a result, the second copy-start key 15 is released from the disabled state. Thus, the second copy-start key 15 can be used with the left little finger of the operator for copying a thick book in the manner as described earlier. After the completion of book-copying, the book-mode key 31 is pressed again so as to cause the second copy-start key 15 to be disabled. Thereafter, only the first copy-start key 14 can be used for copying originals of sheets.

Next, the procedures for registering an ID number will be described. As shown in FIG. 6, the control panel comprises an AC (all clear) key and a C (clear) key. These keys are provided between the ten-key numerical input pad 32 and the first copy-start key 14. To activate the ID number registration mode, three keys such as the AC key, the C key and the key "7" of ten-key numerical input pad 32, are pressed simultaneously. The message display 33 then displays that the input of an ID number to be registered is requested. In accordance with this display the operator inputs the ID number of a four-digit number, for example, by the use of the ten-key numerical input pad 32. The thus input ID number is stored in a control unit (not shown), and the prescribed ID number registration is completed.

Figure 7:
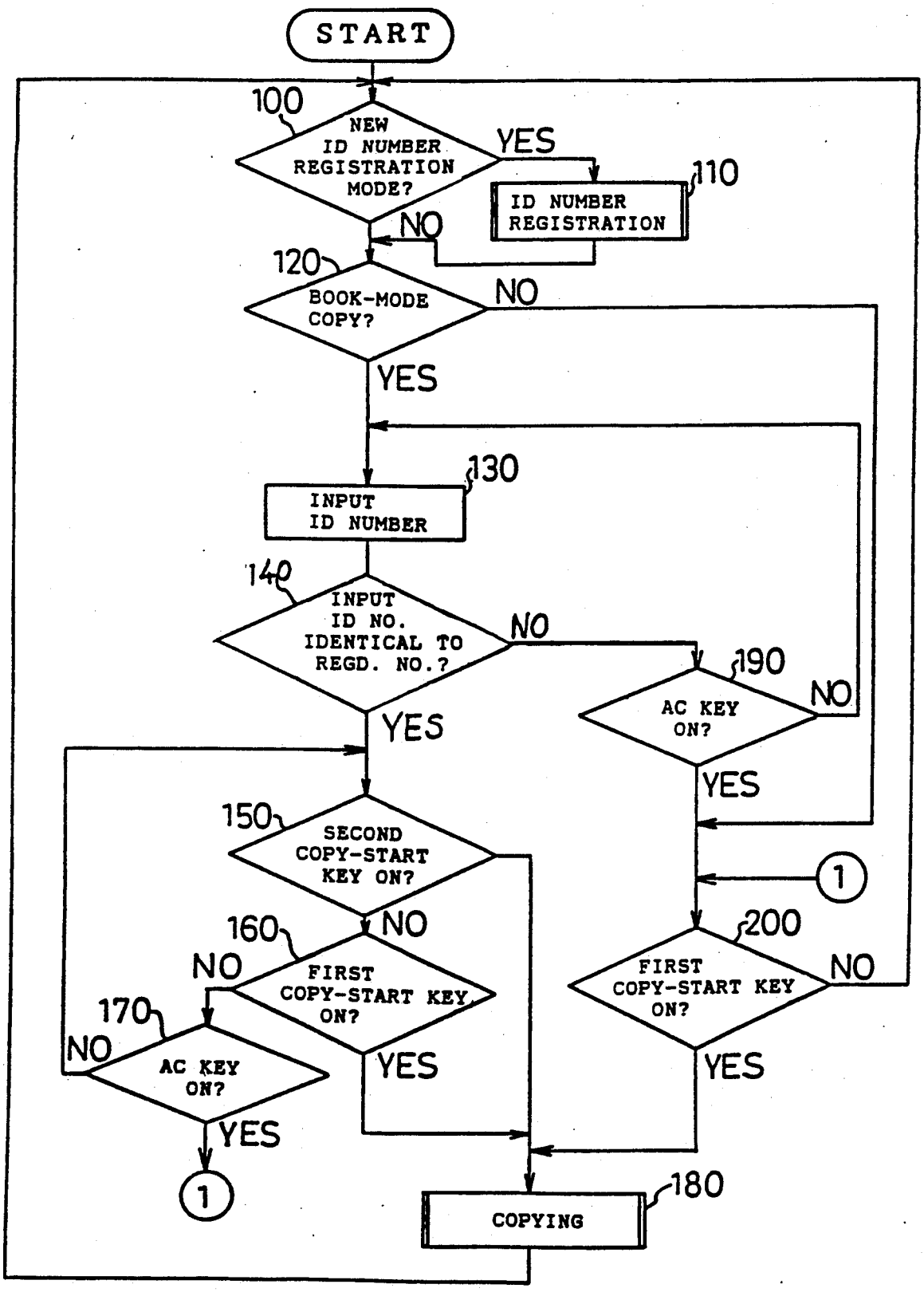
FIGS. 7 and 8 are flow charts for explaining the operation of one embodiment according to the present invention.
Figure 8:
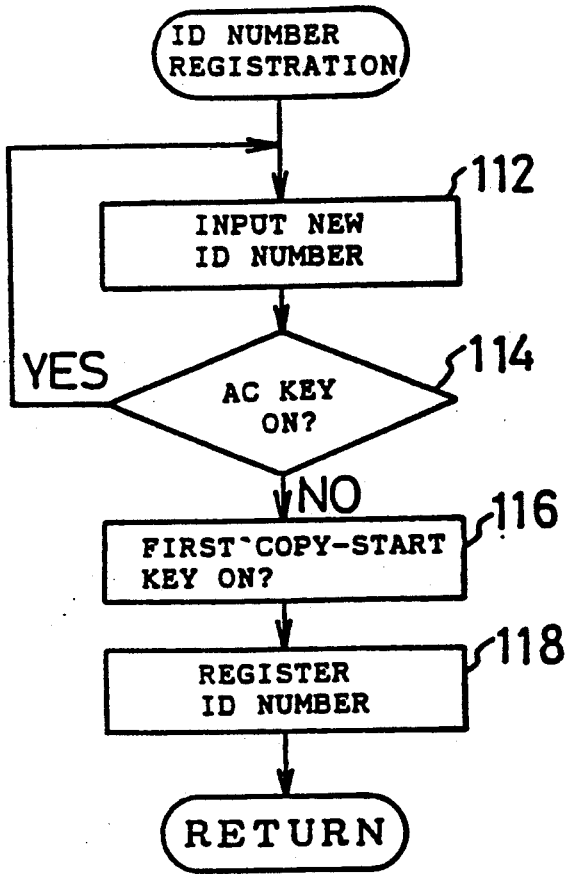

The operation of this embodiment will be described with reference to flow charts shown in FIGS. 7 and 8.

First, the power switch of the machine 1 is turned on. Thereafter, the operator determines whether or not a new ID number must be registered (STEP 100). In the case when a new ID number must be registered, the procedure advances to STEP 110, which will be later described. In the case when a new ID number is not required to be registered, the procedure advances to STEP 120 in which the message display 33 displays "Is book-mode copying requested?". When the book-mode copying is required, the operator presses the book-mode key 31. When the book-mode key 31 is pressed, the procedure advances to STEP 130 in which the message display 33 displays "What is your ID number?". The operator then inputs the ID number, i.e., a four-digit number, for example, by the use of ten-key numerical input pad 32. The control unit (not shown) compares the thus inputted ID number with the registered ID numbers, and judges whether or not the input ID number has been registered previously (STEP 140). If the result of the judgment is "YES", the procedure then advances to STEP 150, and if it is "NO", the procedure advances to STEP 190.

When the procedure has reached STEP 150, the second copy-start key 15 is released from the disabled state. In STEP 150, the operator determines whether to press the second copy-start key 15. If the key 15 is pressed, the procedure then advances to STEP 180 wherein the above-described copying operation is performed. In other words, a thick book set on the original table 2 can be copied easily by the use of the left little finger of the operator whose hands are engaged in depressing the thick book. If the key 15 has not been pressed for a prescribed time, the procedure advances automatically to STEP 160 wherein the operator determines whether to press the first copy-start key 14. In STEP 160, if the key 14 is pressed, the procedure advances to STEP 180. If the key 14 has not been pressed for a prescribed time, the procedure advances automatically to STEP 170 wherein the operator determines whether to press the AC key. In STEP 170, if the AC key has not been pressed for a prescribed time, the procedure returns automatically to STEP 150. In STEP 170, if the AC key is pressed, the pocedure advances automatically to STEP 200 wherein the operator determines whether to press the key 14. In STEP 200, if the key 14 is pressed, the procedure advances to STEP 180. If the key 14 has not been pressed for a prescribed time, the procedure returns automatically to STEP 100.

On the other hand, when the procedure has reached STEP 190, the operator determines whether to press the AC key. If the AC key has not been pressed for a prescribed time, the procedure returns automatically to STEP 130 wherein an ID number is to be input. In STEP 190, if the AC key is pressed, the procedure then advances to STEP 200, and thereafter the operation is performed in the same manner as described above.

In STEP 100, when the operator selects the new ID number registration mode, the procedure advances to STEP 110. This selection is made by simultaneously pressing three keys, such as the AC key, the C key and the key "7" of ten-key numerical input pad 32. FIG. 8 shows STEP 110 which is a sub-routine of the new ID number registration beginning with STEP 112. In STEP 112, the operator inputs a desired ID number of a four-digit number, for example, by the use of ten-key numerical input pad 32. If the input of an ID number is performed erroneously, then the AC key is pressed for correction (STEP 114), and thus the procedure returns to STEP 112. When the ID number has been input correctly, the AC key is not pressed. The procedure then advances to STEP 116 wherein the first copy-start key 14 is to be pressed. When the operator presses the first copy-start key 14, the registration of the desired ID number is performed (STEP 118). After the completion of the ID number registration, the procedure returns automatically to STEP 120 of FIG. 7.

As described above, according to the present invention, the second copy-start key 15 is disabled until a prescribed procedure is performed so as to release the key 15 from the disabled state. Thus, an undesirable copying operation, which may be caused by accidentally touching the key 15, is effectively avoided. Moreover, the operators who can enable the second copy-start key 15 may be limited to those having the registered ID numbers.

Obviously, numerous additional modifications and variations of the present invention are possible in light of the above teachings. It is therefore to be understood that within the scope of the appended claims, the invention may be practiced otherwise than as specifically described herein.

What is claimed is:

1. An image forming apparatus comprising:

a copying machine main body;

a rectangular control panel provided on the upper surface of said main body;

an original table cover provided at a position opposite to said control panel;

a transparent original table provided on the upper surface of said main body at a position between said control panel and said original table cover;

a first copy-start key provided on one end of said rectangular control panel, being continuously in an enabled state;

a rectangular periphery located around the original table;

a second copy-start key located in the center of the portion of the rectangular periphery which is perpendicular to the control panel and which is most distant from the first copy-start key, said second copy-start key normally being in a disabled state; and controlling means for changing the second copy-start key from the disabled to an enabled state.

2. The apparatus of claim 1, wherein said controlling means comprises a book-mode key provided on said control panel, means for inputting ID numbers, means for comparing the input ID number with registered ID numbers which have been previously stored in the main body, and means for releasing said copy-start key from the disabled state only when the input ID number is identical to a register ID number.

* * * * *